US012123687B2

(12) United States Patent
Norris

(10) Patent No.: US 12,123,687 B2
(45) Date of Patent: Oct. 22, 2024

(54) STEERABLE PROJECTILE

(71) Applicant: BAE SYSTEMS plc, London (GB)

(72) Inventor: James Joshua Norris, Swindon (GB)

(73) Assignee: BAE SYSTEMS PLC, London (GB)

( * ) Notice: Subject to any disclaimer, the term of this patent is extended or adjusted under 35 U.S.C. 154(b) by 71 days.

(21) Appl. No.: 18/007,133

(22) PCT Filed: Jul. 21, 2021

(86) PCT No.: PCT/GB2021/051866
§ 371 (c)(1),
(2) Date: Jan. 27, 2023

(87) PCT Pub. No.: WO2022/023706
PCT Pub. Date: Feb. 3, 2022

(65) Prior Publication Data

US 2023/0228546 A1 Jul. 20, 2023

(30) Foreign Application Priority Data

Jul. 30, 2020 (EP) ..... 20275128
Jul. 30, 2020 (GB) ..... 2011850

(51) Int. Cl.
*F42B 10/62* (2006.01)
*F42B 10/46* (2006.01)

(52) U.S. Cl.
CPC ..... *F42B 10/62* (2013.01); *F42B 10/46* (2013.01)

(58) Field of Classification Search
CPC ..... F42B 10/62; F42B 10/46; F42B 10/60
See application file for complete search history.

(56) References Cited

U.S. PATENT DOCUMENTS

2008/0142591 A1* 6/2008 Jenkins ..... F41G 7/346 235/411
2016/0033244 A1 2/2016 Minnicino, II

FOREIGN PATENT DOCUMENTS

DE 102005043474 A1 3/2007
EP 2263058 B1 10/2013
GB 2458332 A 9/2009
WO 2007/030687 A2 3/2007
WO WO-2009112829 A1 * 9/2009 ..... F42B 10/46
(Continued)

OTHER PUBLICATIONS

International Search Report and Written Opinion received for PCT/GB2021/051866. Mailed: Oct. 22, 2021. 11 pages.
(Continued)

*Primary Examiner* — Justin M Benedik
(74) *Attorney, Agent, or Firm* — Finch & Maloney PLLC

(57) ABSTRACT

There is provided a projectile, a system and a related method of operation of a projectile comprising: a front ogive section; an aft section; and a control module; wherein the front ogive section is rotatably connected to the aft section by a coupling device, the front ogive section further comprising an asymmetric surface such that the asymmetric surface exerts an imbalance upon the projectile, where in use, the angular rotation of the front ogive section can be selectively adjusted relative to the aft section by commands from the control module to the coupling device influencing a helical trajectory of the projectile in flight thereby causing a change in direction thereby steering the projectile towards a target.

19 Claims, 6 Drawing Sheets

(56) References Cited

FOREIGN PATENT DOCUMENTS

| | | | |
|---|---|---|---|
| WO | 2010/039322 | A2 | 4/2010 |
| WO | 2022/023706 | A1 | 2/2022 |

OTHER PUBLICATIONS

GB Search Report under Section 17(5) received for GB Application No. 2011850.1, dated Nov. 27, 2020. 3 pages.
Extended European Search Report received for EP Application No. 20275128.5, dated Jan. 29, 2021. 9 pages.

* cited by examiner

STEERABLE PROJECTILE

The present invention relates generally to a steerable projectile and a related system and method for controlling a steerable projectile.

Conventional guided projectiles have been used by modern militaries for decades as precision strike weapons for high value targets. Such guided projectiles are known to use external protruding control surfaces or thrust vectoring to steer the projectile in flight towards a target. The most prevalent means of steering a guided projectile is via the use of protruding control surfaces into an airflow to alter the roll angle of the projectile in combination with exerting a control force on the guided projectile by actuating a control surface. This is achieved by rolling the projectile to align the controllable pitch axis with the desired direction, then actuating the control surface thereby exerting a force which results in lateral movement of the projectile, thus steering the projectile in flight.

A further example of controlling a projectile is that used in both BAE Systems' Silver Bullet™ & Thales STAR-Streak®, the control is achieved using a dual spin arrangement wherein the forward and aft sections of the projectile are spun relative to each other via a suitable mechanism in order to align the controllable pitch axis into the desired angle. Such examples utilise protruding control surfaces in order to exert a force on the projectile.

Smaller calibre projectiles suffer a trade-off between internal volume required for control and guidance hardware versus propellant, charge and/or explosive volume.

There is therefore an emerging requirement to drive a reduction in spatial volume of guidance and control hardware within projectiles in order to increase volumes of propellant, charge, explosives, and/or sensors to increase the endurance, range and lethality of small calibre projectiles.

It is an example aim of the present invention to at least partially solve or avoid one or more problems or disadvantages with guided projectiles, whether identified herein or elsewhere, namely that of steering projectiles without the use of protruding external fins.

According to a first aspect of the present invention, there is provided a projectile comprising: a front ogive section; an aft section; and a control module; wherein the front ogive section is rotatably connected to the aft section by a coupling device, the front ogive section further comprising an asymmetric surface such that the asymmetric surface exerts an imbalance upon the projectile, where in use, the angular rotation of the front ogive section can be selectively adjusted relative to the aft section by commands from the control module to the coupling device, wherein a first arrangement, the coupling device is coupled, such that the front section spins at the same angular rotation as the aft section, the projectile travelling in a first helical trajectory, and, in a second arrangement the coupling device is decoupled, such that the front section spins at a slower angular rotation relative to the aft section, the projectile travelling in a second helical trajectory, said first helical trajectory comprising a smaller radius than the second helical trajectory, wherein selective activation between the first and second arrangements, causing a change in direction thereby steering the projectile towards a target.

The selective adjustment of the angular rotation of the front ogive section allows the overall helical trajectory to be constantly adjusted via the control module thereby inducing a net change of direction thereby allowing the projectile to be steered effectively. It will be appreciated that in the instance when the front ogive section is slowed relative to the aft section, the angular rotation of the front ogive section relative to a plane of measurement, for example the surface of the earth, is non zero. That is to say, the front ogive section will continue to spin at an angular rotation less than the aft section and does not remain stationary with respect to the plane of measurement i.e. the ground.

The radius of the helical trajectory is the radius of the helix often referred to radius of curvature of the helix.

The front ogive section is defined relative to the direction of travel of the projectile as the leading section of the projectile and the aft section defined as the trailing section relative to the direction of travel. It will be appreciated that although only two sections have been discussed, there may be further intermediate sections positioned between said front ogive section and aft sections or in advance of the front ogive section or to the rear of the aft section, for example, a fuze or sensor section in advance of the front ogive section. Base bleed, tracer effects or rocket assists may be located rearward of the aft section. Said intermediate sections may rotate relative to the front and/or aft sections or may remain stationary with respect to the front and/or aft sections. The aft section may be the entire section of the projectile that is rearward of the ogive section.

Preferably, arrangement is such that the mass of the aft section is greater than the ogive section.

The front ogive section and aft section may be made of metal, metal alloys, polymers or composites. The front ogive section and aft section may be made of the same or different materials. The front ogive section and aft section may be made from materials chosen according to calibre. Preferably, the front ogive section and aft section are made from metal or metal alloys. The chosen material may fulfil the demands of any engagement scenario or design requirement. For example being made of more/less dense materials to balance the centre of mass, or being made of hardened materials, for example hardened steels, titanium or carbides, nitrides, to improve terminal performances. As an example, when the calibre is SAA in the range of from 4.6 mm to 12.7 mm the front ogive section and aft section may be made from an inner core of lead or high hardness steel that is enveloped by a copper jacket or copper deposed coating. In a further example, when the projectile is a shell, such as, for example in the range of from 29 mm to 155 mm the front ogive section and aft section are made from steels. The intermediate calibres of 10 to 40 mm, may be made from their typical metal, metal alloys.

The ogive section may be made from a material which has a greater hardness than the aft section. The asymmetric surface is required to control the trajectory, therefore it is desirable that the asymmetric surface is not damaged or deformed during launch. The shape and form of said asymmetric surface will be precision formed, i.e. fine-tuned, so unwanted, or unpredictable, deformation may provide unwanted or unexpected movements of the projectile during activation, and thereby lead to a reduction in predictable control of the trajectory of the projectile.

The front ogive section, aft section and any intermediate sections may be solid to act as a mass damper. Alternatively, the front ogive section, aft section and any intermediate sections may contain recesses and/or voids in order to carry auxiliary equipment, for example, sensors, propellant charges, pyrotechnics and explosives and such like. The front ogive section may also contain grooves or striations to improve aerodynamic efficiency or enhance guidance capabilities.

The front ogive section and the aft section are rotatably connected by a coupling device. The axis of rotation of the coupling device is about the longitudinal axis of the projectile.

The coupling device may be co-axially located within the projectile.

The coupling device function is to selectively couple and decouple the relative rotation between the front ogive section and aft section. In the coupled mode, the front ogive section rotates at the same angular rotation as the aft section. In the uncoupled mode, the front ogive section is allowed to or caused to rotate at a different angular rotation with respect to the aft section. Further the coupling device may provide partial coupling, such that the rate of angular rotation between the front ogive and the aft section may be selectively controlled.

The coupling device may be a passive coupling device to slow rotation of the front ogive section relative to the aft section. In this sense, a passive coupling device is non-driven. The passive coupling device may be mechanical, electromechanical, electromagnetic, or electronic. The passive coupling device may be a brake or a piezoelectric stack. The brake may be a mechanical device, for example a friction brake such as a disc or drum brake. Alternatively, the brake may be a pumping brake. Alternatively, the passive coupling device may comprise a piezoelectric stack which expands to form an interference fit between the front ogive section and aft section in order to slow the relative angular rotation. In a substantially friction free passive coupling device, in the decoupled state, the mass of the aft section is greater than the ogive section, therefore the aft section will have greater momentum than the ogive section, the ogive section will start to rotate at a slower angular momentum. The passive coupling device may be activated to decouple, partially decouple, or even stop the angular rotation of the ogive section relative to the aft section. When the passive coupling device is engaged, or partially engaged to re-couple i.e. couple the ogive section to the aft section, the angular rotation momentum of the aft section will be partially transferred to the ogive and cause them to rotate at the same rate.

The coupling device may comprise an active coupling device such that the angular rotation of the front ogive section can be increased or decreased relative to the angular rotation of the aft section. In this sense, an active coupling device is driven. Such active coupling devices may include a motor assembly.

Where the active coupling device is a motor, for example a servo motor, this allows for active control of the angular rotation of the front ogive section such that it can be progressively slowed and/or increased at differing rates relative to the aft section i.e. a non-linear reduction or increase in angular rotation.

The active coupling device may be an electromagnetic brake assembly, with embedded electromagnets between the front ogive section and aft section, which may be selectively energised in order to increase or decrease the angular rotation of the front ogive section relative to the aft section. This also allows for active control of the angular rotation of the front ogive section such that it can be progressively slowed and/or increased at differing rates relative to the aft section i.e. a non-linear reduction or increase in angular rotation.

Preferably, the coupling device is a passive coupling device. More preferably, the passive coupling device is a brake.

The coupling device may comprise a central shaft linking the front ogive section to the aft section. The aft section and ogive sections, being rotatably mounted thereon. The shaft may be the inner core of a projectile.

The projectile may comprise an electrical connection between the front ogive section and aft section. The electrical connection may be completed between the front ogive section and aft section by way of an electrical slip ring or via the central shaft.

The asymmetric surface of the front ogive section may be any shape such that, in flight, said shape exerts an imbalanced force on the projectile by deflection of the oncoming airflow. For example, the profile of the asymmetric surface may be a chamfer, a fillet, a round, a bulbous profile or conversely, a relief such as a channel or any other suitable profile which enables oncoming air to be deflected to create a net imbalance on the projectile.

The asymmetric surface of the front ogive section may comprise an aerodynamic lifting surface. The aerodynamic lifting surface may be any shape where, in flight, said shape exerts a lifting force on the projectile by deflection of the on-coming airflow. For example, the profile of the aerodynamic lifting surface may be a chamfer, a blunted ogive, a truncated ogive, a fillet, a round, a relief, a NACA profile or a bulbous profile or any other suitable profile which enables oncoming air to be deflected to create a lifting force on the projectile. It will be appreciated however that simpler designs such as a truncated ogive where there is provided a flattened face on the ogive lend themselves to mass production techniques.

In a preferable arrangement, the asymmetric surface of the front ogive section is an aerodynamic lifting surface. More preferably, the aerodynamic lifting surface is a truncated ogive.

In a preferable arrangement, the profile of the asymmetric surface is within the diameter of the projectile, i.e. it does not extend out-with the bounds of the plan view of the projectile. Such arrangement avoids the need for deployment mechanisms, which use valuable internal space within the projectile, to deploy the asymmetric surface out-with the original diameter of the projectile after firing.

The projectile may be capable of deforming to create the asymmetric surface after firing. Such asymmetric surface may be created by a piezoelectric effect, mechanical deformation, chemical decomposition or any other suitable means whereby the projectile may deform into an asymmetric surface after firing, for example, a secondary charge which explodes to deform the front ogive section into an asymmetric surface. Such arrangement allows for lower drag coefficients on the projectile for a period of time whilst in the symmetric configuration, for example, during a long transit time. When guidance is required near a target area, the projectile may be actively and controllably deformed to create the asymmetric surface thereby enabling guidance and control.

The deformation of the projectile to create the asymmetric surface may be reversible such that in different phases of flight, the projectile can be selectively deformed and restored to selectively enable guidance and control.

The projectile may comprise a retractable element to selectively create the asymmetric surface. Such retractable element may be selectively engaged and disengaged in order to create the asymmetric surface. Said retractable element may be housed within the front ogive section or both the front ogive section and aft section.

The retractable element may be arranged in combination with, or separate to, the deformable asymmetric surface as herein described.

The asymmetric surface may extend in the range of from 1 to 359 degrees around the plan face of the projectile. Preferably, the asymmetric surface extends in the range of from 40 to 180 degrees around the plan face of the projectile.

The projectile may comprise a continuous surface, for example the outer profile of the projectile may be a smooth blended surface absent from protruding fins or control surfaces i.e. the projectile has a uniform ogive "bullet" shape.

It will be appreciated that absence of fins or movable control surfaces, reduces the requirement for maintenance and inspection of said fins and control surfaces, this may lead to increased reliability of the projectile. Further, the absence of protruding fins and control surfaces has been found to substantially reduce the required internal space within the projectile for associated control modules, motors, actuators etc. which allows for an increase in charge, propellant, explosive material, and sensors to be carried or alternatively can be used to minimise mass on a projectile. Further, external fins or control surfaces are susceptible to damage during launch, such as, for example from vibrations and/or collisions with the barrel) if they are a comparable size to the calibre of the projectile. In addition, the deployment or actuation mechanisms used to deploy the external control surfaces are susceptible to failure during extreme launch environments.

The projectile may be suitable to be fired from a smooth bore barrel, such that no spin is imparted upon the projectile at launch, in such an arrangement an active coupling device may be required to cause a differential angular rotation between the aft and ogive section.

In use, a smooth bore projectile will travel in a substantially straight line trajectory neglecting gravity. The asymmetric surface may exert an imbalance upon the projectile creating a net force acting on the projectile thereby altering the course of the projectile. It will be appreciated that in a smooth bore, unspun projectile, the coupling device must be an active coupling device in order to change the relative angular rotation of the ogive compared to the aft section, to allow the resultant vector of the force imbalance caused by the asymmetric surface. In an unspun projectile, there is no energy which can be harvested from the aft section spin in order to change the angular direction of the asymmetric surface of the front ogive section. Therefore, utilising an active coupling device, for example, a servo motor, the front ogive section comprising the asymmetric surface is selectively rotated clockwise or anticlockwise relative to the aft section in order to direct the imbalanced force in the correct direction and thereby control the trajectory of the projectile.

In a highly preferred arrangement the projectile may be a spun projectile which is fired from a rifled barrel, such that the rifling in the barrel imparts a spin on the projectile during launch and flight. Such spin is often used by projectiles to provide ballistic stability during flight, the projectile may have inherent instability due to weight distribution along the length of the projectile being commonly biased to the aft end. In a rifled projectile, the projectile will travel in a substantially helical path towards a target.

In the spun projectile arrangement comprising the coupling device, the front ogive section comprising the asymmetric surface is selectively coupled and decoupled with the aft section. In the decoupled mode, the front ogive section will begin to slow the rate of spin with respect to the aft section due to an aerodynamic roll damping moment.

After a period of time the system will reach a new steady-state, where spin rate of the front ogive section is slower than the aft section. The control force from the aerodynamic surfaces on the ogive act in a tangential direction for longer, resulting in a larger radial acceleration. The projectile thus travels further radially before the control force rotates to oppose the motion. The result is that in the decoupled state, the trajectory forms a larger helix diameter than in the coupled mode. The coupling device may then be disengaged, to allow the front ogive section to be progressively re-coupled with the aft section, the front ogive section may then be accelerated by the aft section, which still has the relatively higher spin rate, back to the initial state the system was in before the brake was first decoupled returning to the substantially original, smaller helix diameter.

In comparison to the use of external protruding fins and thrust vectoring to exert a control force on a projectile as is known in the art. The coupling and decoupling of the front ogive section with respect to the aft section using the coupling device results in the ability to selectively increase and decrease the helix diameter of the projectile thereby enabling effective steering of the projectile towards a target.

In a spun projectile the arrangement may comprise an active coupling device, for example a servo motor, the front ogive section may be selectively rotated clockwise or anticlockwise relative to the aft section. Such arrangement works in a similar fashion to that of the passive coupling device, ie the braking device, however an active coupling device may result in faster settling times of the system to a steady state which enables the projectile to action more commands within a given timeframe thereby enabling greater precision in guiding the projectile towards a target.

Preferably, the projectile is a spun projectile comprising a passive coupling device.

The control module is operably linked to issue guidance commands to the coupling device to steer the projectile to a target. The control module causes the coupling device to selectively couple and decouple the ogive and aft section based on the issued guidance commands.

The control module may comprise internal guidance instrumentation such as for example, gyroscopes, accelerometers or other inertial sensors such that the projectile can inherently calculate its position relative to a pre-loaded target without reference to an external targeting and/or location system.

The control module may further comprise sensors such as for example, optical sensors, RF sensors and such like in order to determine the location of a target in flight and calculate and issue guidance commands to steer the projectile to said target.

The control module may be located in the front ogive section or the aft section or any intermediate section. Preferably, the control module is located in the aft section.

The projectile may comprise a receiver for receiving guidance instructions from an external targeting and/or location system. Said receiver may include for example, an RF receiver or an optical receiver.

The projectile may be linked by a wire to a launch point wherein signals can be received via the wire. The launch point may be in communication with the control module. In a preferable arrangement, the projectile may comprise an optical receiver.

The guidance instructions may originate from an external targeting and/or location system, for example, a laser designator, GPS transmitter, RF transmitter or electrical signals via wire or optical guided projectile arrangement.

In a further preferable arrangement, the projectile may be a beam rider projectile such that the projectile comprises an optical receiver wherein the projectile attempts to stay on the path of a laser beam based on the strength of laser signal on the optical receiver.

The projectile may comprise a transmitter for transmitting the projectile's position. Said transmitter may include for example, an RF transmitter or an optical transmitter. The projectile may be mounted with an array of sensors to relay position and orientations to the control system. The projectile may also be fitted with some passive or active identifier, such as a reflective surface or RF beacon, which an external observer can use to identify the location of the projectile using imaging equipment and sensors. In a preferred arrangement, the projectile may comprise a passive surface to reflect light back to an observer, so as to minimise power consumption. The transmitter may be in communication with the control module.

The transmitter for transmitting the projectile position may aide in the location and acquiring of guidance instructions from an external transmitter.

The projectile may need to both transmit and receive, any may comprise a transceiver module, to allow two-way communication.

The projectile calibre may vary in the range of from small calibre direct fire projectiles, bullets, for example .22LR to indirect fire projectiles, artillery shells, such as, for example up to 155 mm shells, or larger.

It will be appreciated by the skilled person that the teachings contained herein may be applied to any calibre projectile providing a coupling device is embedded within the projectile to allow the rate of angular rotation of the front ogive and aft section to be selectively controlled, and wherein the front ogive section comprises an asymmetric surface such that an asymmetric force can be exerted upon the projectile thereby enabling guidance and control.

According to a second aspect, there is provided a system for controlling a projectile to a target, the system comprising: a projectile according to the first aspect, and; a targeting system, wherein the control system of the projectile receives guidance instructions from the targeting system thereby enabling the projectile to be steered to the target.

The system may be arranged such that the projectile receives guidance instructions from the targeting system as herein described in the first aspect.

The system may be arranged such that the projectile transmits its position to the targeting system as herein described in the first aspect.

Without being bound by theory, one example of guidance is to determine the projectile lateral acceleration (Latax) as a function of the size of the angle through which the front ogive section is slowed ($2\phi_\alpha$) and the direction about which the bias manoeuvre is centred ($\phi_B$). Starting from the fundamental laws of motion, it can be shown that the latex of the projectile a can be written as $$\tilde{a} = \begin{bmatrix} a_x \\ a_y \end{bmatrix} = \frac{\int_0^\tau F(\phi, \phi_a) \cdot dt}{m \int_0^\tau \omega^{-1}(\phi, \phi_a) \cdot d\phi} \begin{bmatrix} \cos(\phi_B) \\ \sin(\phi_B) \end{bmatrix}$$

Where $\alpha_x$ and $\alpha_y$ are the horizontal and vertical projectile latex respectively, F is the control force acting on the projectile, m is the projectile mass, and $\omega$ is the rotational speed of the front ogive section (and thus the control force).

These terms can either be solved analytically or numerically, under different assumptions. In either case, this latex equation can then be used in conjunction with any existing or novel guidance law (such as proportional navigation) to control the projectile.

One simple assumption that may be made is to model the asymmetric surface as exerting a constant force $F_c$ through a roll angle $\phi$ with rate $\omega_0$ or $\omega_1$ where $\omega_0<\omega_1$. The term $\Phi\in[0,2\pi]$, describes the roll orientation of $F_c$ with respect to the normal axis of the projectile. The model uses fixed magnitude $F_c$ rolling at speed $\omega_1$. The roll rate is slowed to $\omega_0$ through favourable roll angles when $F_c$ is aligned with the desired correction axis, then accelerated back to $\omega_1$ through the remaining unfavourable roll angles. The act of slowing $F_c$ when sweeping through favourable roll angles is henceforth referred to as 'bias'. The switching between spin speeds is instantaneous.

The integral of Newton's second law relates to the impulse of an object, J, to its change in velocity $\Delta v$.

$$J|\Delta t = m\Delta v|\Delta t$$

wherein the mass m is assumed to be constant since there are no on-board resources being consumed.

A generalised decomposition of $F_c$ onto any orthonormal axis i, j, in the plan view plane of projectile, herein denoted as YZ has the corresponding forces $F_i$, $F_j$. Let the desired decomposition axis i be an angle axis $\phi_B$ from the normal axis $\hat{z}$ (where $\phi=0$). Let $\phi_i$ be a particular angle between $F_c$ and the arbitrary decomposition axis i. Let $\phi_\alpha$ be the angle through which $F_c$ sweeps at a given rate $\omega$ such that the sweep begins at the angle $(\phi_B-\phi_\alpha)$ and ends at $\phi_B$.

The range of angles during which $F_c$ is slowed is defined as the bias angle. Let the mid-point of the bias angle coincide with decomposition axis i, such that the symmetrical angle on either side of the midpoint is $\phi_\alpha$. The bias angle thus starts at $(\phi_B-\phi_\alpha)$ and ends at $(\phi_B+\phi_\alpha)$ with a midpoint of $\phi_B$. $F_c$ will continue to rotate through the rest of the angle @ eventually sweeping another angular range $(\phi_B+\pi)\pm\phi_\alpha$ (wrapped so $\phi\in[0,2\pi]$). During this time the resulting change in velocity is directed along the negative $i^{th}$ axis.

$\Delta V$ is defined as the total change in velocity of one whole roll rotation in sweeping through equal but opposing angles of size $2\phi_\alpha$, at different rates $\omega_0$ and $\omega_1$. Assuming $F_c$, m and $\omega$ are constant, it can be shown from that;

$$\Delta V = \frac{2F_c}{m}\sin(\phi_a)\left(\frac{\omega_0-\omega_1}{\omega_0\omega_1}\right)$$

The maximum bias angle is half of a roll rotation, $\phi_{\alpha,max}=\pi/2$. The maximum $\Delta V$ per rotation is thus given by;

$$\Delta V_{max}=\Delta V|\phi_\alpha=\pi/2.$$

which is evaluated for a given system.

One example of a novel guidance law is the following Quasi-dynamic Guidance Law (QDGL). The QDGL calculates a desired change in speed when $\phi=0$, then calculate the bias angles from the above equation. The projectile will then continue to roll, whereby the asymmetric surface will slow the roll if the current roll angle lies within the bias range previously calculated.

In practice, the desired speed change and resulting bias angles are calculated when $\phi$ lies in a small range, $\phi\in|0, 0.001|$, to account for the control module inaccuracy. While this calculation could be conducted and updated continuously, the relative speeds would have to transformed to the $\phi=0$ reference frame which adds another layer of computational complexity. In addition, this discrete computation of speeds at the beginning of each rotation accommodates the bandwidth of hardware with respect to the roll rate of the projectile.

The current relative velocity of projectile to target is the difference between the projectile and target velocity, $$V_R = \begin{bmatrix} u_R \\ v_R \end{bmatrix} = \begin{bmatrix} u - u_T \\ v - v_T \end{bmatrix}$$

To achieve a circular trajectory in the resting state, the horizontal velocity at the beginning of the bias calculation must assume the control force has already rotated through one quarter rotation. Taking this into consideration, we define $V_{DR0}$ as the $\Delta V$ correction necessary to bring the projectile to a stable circular orbit relative to the target, including the current relative velocity;

$$V_{DR0} = \begin{bmatrix} u_R + \Delta V|\phi = \pi/4. \\ v_R \end{bmatrix}$$

This only allows the control module to bring the projectile to relative rest, the desired closing speed $V_{PT}(d)$ describes the chosen approach speed as a function of d. The total demanded velocity change from the velocity control module $V_{D\in m}$ is then a linear combination of the necessary relative speed correction to bring the system to an orbit, $V_{DR0}$, and the closing velocity $V_{PT}(d)$ dictated by the QDGL;

$$V_{D\in m}=V_{DR0}+V_{PT}(d)$$

$V_{PT}d$ must only demand speeds which can be delivered by the asymmetric surface, given that $\Delta V$ can never exceed $\Delta V_{max}$. Let the function $V_{lim}(d)$ be the maximum relative speed the projectile can have at a distance $d \geq 0$, such that it is still able to decelerate in time to be at relative rest when d=0. This function can be calculated by starting with a stationary projectile and applying consecutive $\Delta V_{max}$ biases, since the process is reversible.

An effective acceleration value, $\alpha_{eff}$, is measured from simulations for consecutive $\Delta V_{max}$ biases. Using this, it can be shown that;

$$V_{lim}(d) = (2a_{eff}, d)^{\frac{1}{2}}$$

Since the function $V_{PT}(d)$ is calculated when $\phi=0$ at a particular distance $d_1$, the desired $\Delta V$ will not be achieved until after the bias manoeuvre has been executed, one full rotation later. Hence, the process is discontinuous. By this point the projectile will have moved to some new distance $d_2$, under its residual velocity. This delay causes the system to exceed $V_{lim}(d)$, resulting in an overshoot. To account for the delay, the demanded speed is modified by a value $\xi$ which ensures the relative speed never exceeds $V_{lim}(d)$. The delay does not directly scale with distance but rather with $V_{PT}(d)$ as it is the result of dynamic system evolution. Hence the closing speed function is written as;

$$V_{PT}(d)=V_{lim}(d)-\xi, \xi \in \mathbb{R} \geq 0$$

where $\xi$ is a constant to be optimised.

In one example, the radial velocity of the projectile to the target may be governed by the QDGL equation;

$$V_{PT}(d) = \begin{bmatrix} V_{lim}(d) - \xi \\ V_k \\ 0 \end{bmatrix} \forall\, d \in \begin{cases} d_1 \leq d \\ d_2 \leq d < d_1 \\ 0 \leq d < d_2 \end{cases}$$

wherein;

$V_{PT}(d)$—the lateral speed at which the projectile closes the target (to make the miss distance, i.e. the distance between the target and where the projectile impacts, equal to 0.

$V_{lim}(d)$—the maximum lateral speed correction the projectile is capable of making at full, saturated actuator effort.

$\xi$—delay modification value $V_k$—chosen constant speed to enable quicker dynamic response.

d—lateral distance to target (miss distance).

$d_1$—desired distance to switch from $V_{lim}(d)-\xi$ to $V_k$, to minimise actuator effort and conserve resources.

$d_2$—the desired level of accuracy of the projectile e.g. the acceptable miss distance is within 2 m of target, this is satisfactory and no further corrections are necessary.

The above equation determines what the lateral speed of the projectile should be, depending on what the lateral distance (d) is. If there is a large discrepancy between the target and the estimated trajectory i.e. the projectile is on course to miss the target by a significant distance, the control module will correct it's trajectory as quick as is possible without overshoot ($V_{PT}(d)=V_{lim}(d)-\xi$), if the distance is small, the control module will calculate guidance such that the radial velocity of the projectile is low and be ready for a change to conserve resources ($V_{PT}(d)=V_k$). Finally, if the projectile is on course to hit the target or is within an acceptable miss distance, the control module will not make any further commands thus the projectile will stay on course ($V_{PT}(d)=0$).

According to a third aspect there is provided a method of controlling the projectile, as herein described, towards a target, the method comprising:

firing the projectile from a barrel;

determining the target location, calculating guidance commands to change the trajectory of the projectile to intercept the target, causing said guidance command to instruct the control module to steer the projectile to a target;

wherein in a first arrangement the coupling device is coupled, such that the front section spins at the same angular rotation as the aft section, the projectile travelling in a first helical trajectory, in a second arrangement the coupling device is decoupled, such that the front section spins at a different angular rotation relative to the aft section, the projectile travelling in a second helical trajectory, said first helical trajectory comprising a smaller radius than the second helical trajectory, comprising the step of selective activation between the first and second arrangements, to cause a change in direction, thereby enabling the projectile to be steered to the target.

The method may comprise a step wherein the projectile receives guidance instructions from an external targeting system.

The method may comprise the step wherein the projectile transmits its position.

Several arrangements of the invention will now be described by way of example and with reference to the accompanying drawings of which;

Figure 3B:
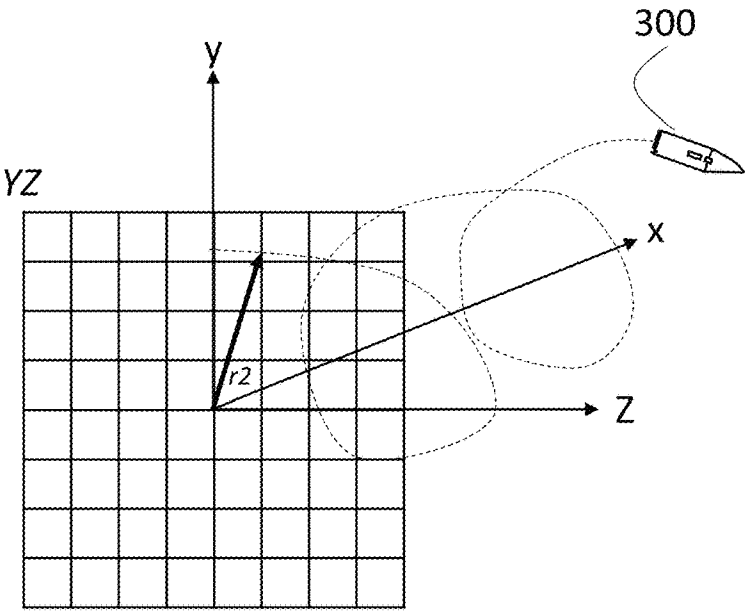
Figure 3A:
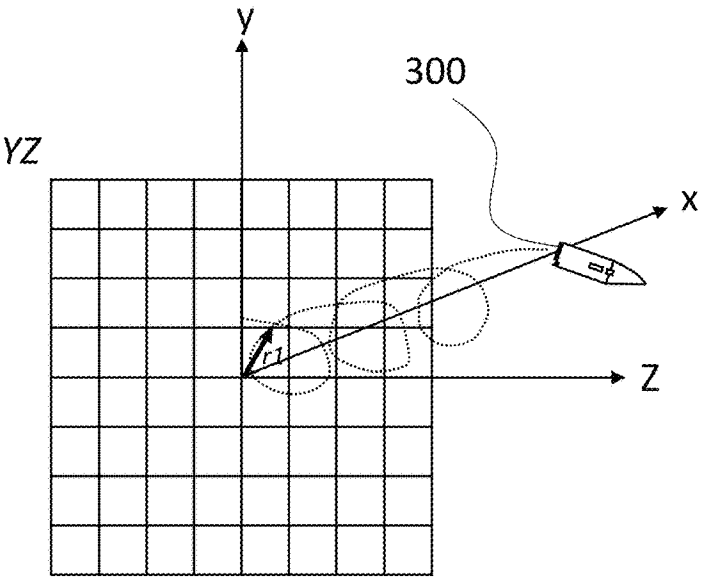

FIGS. 3*a* & 3*b* show a helix trajectory plot of a rifled projectile.

Figure 4:
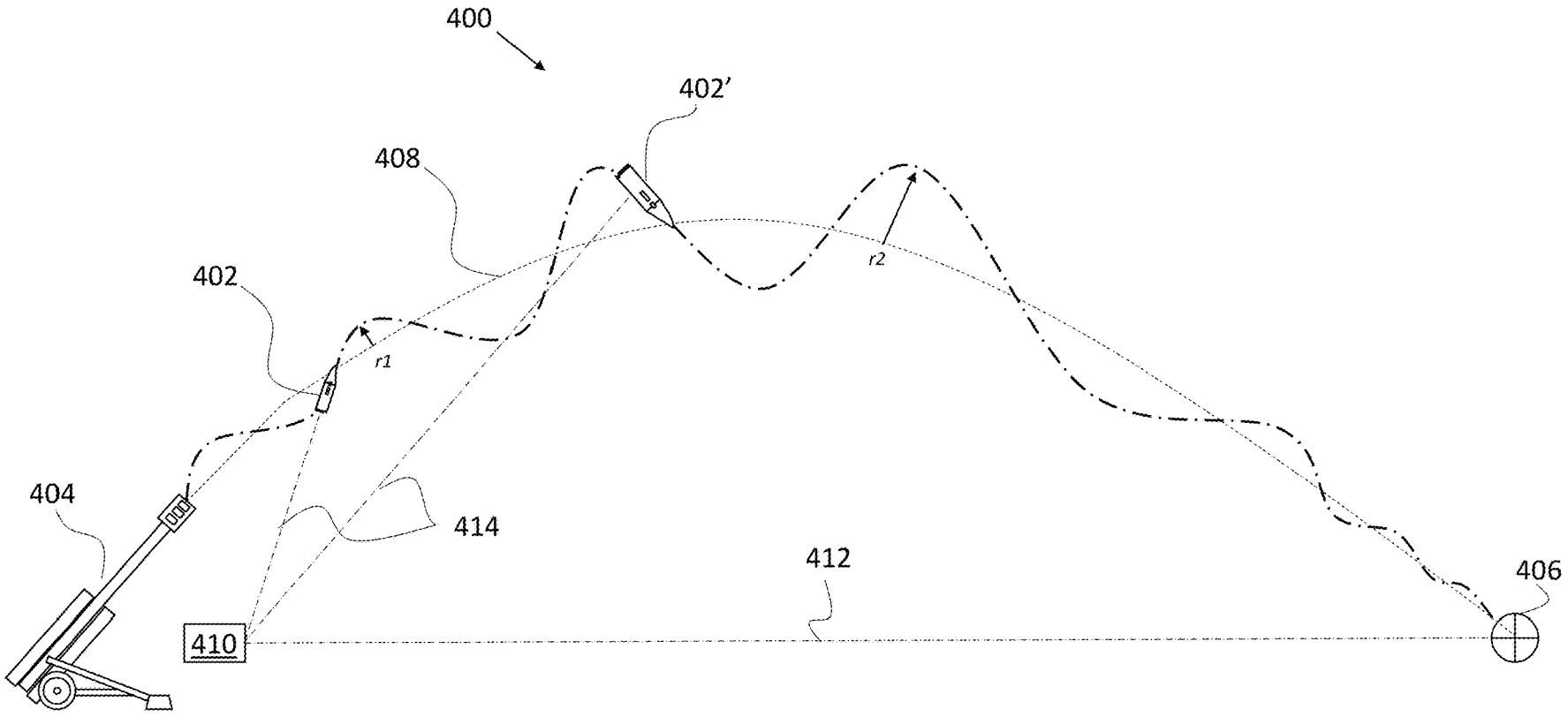

FIG. 4 shows a system of a rifled projectile fired from an artillery gun.

Figure 5:
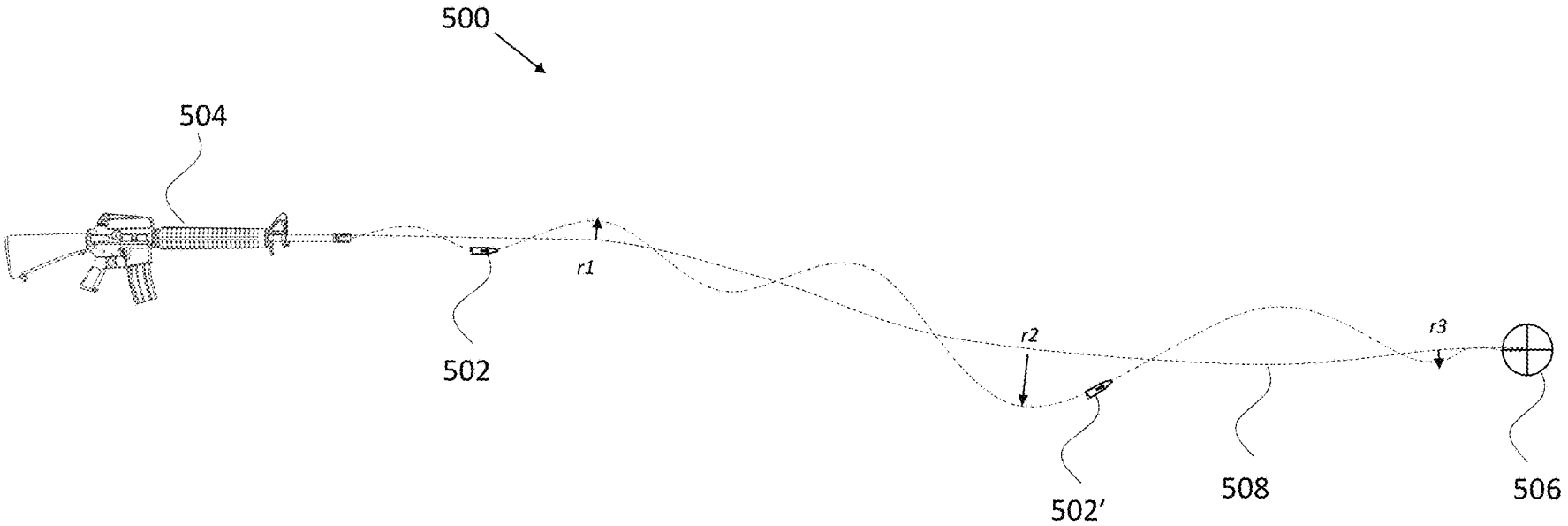

FIG. 5 shows a system of a rifled projectile fired from a hand held weapon.

Figure 6:
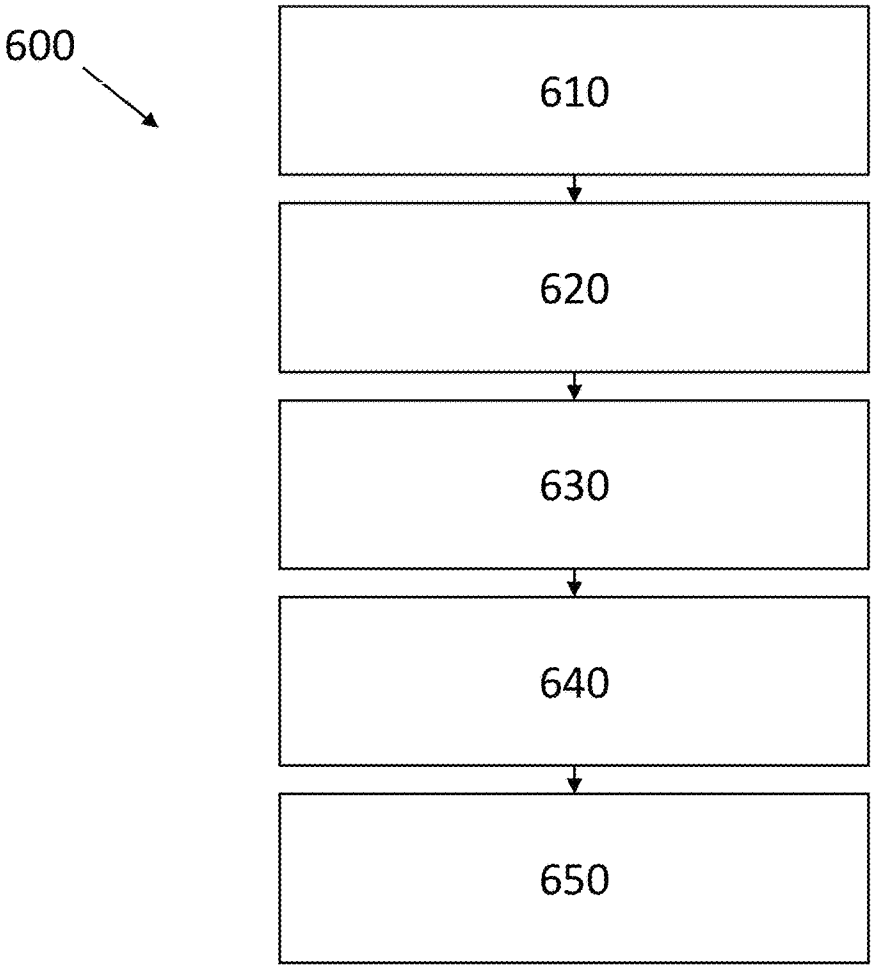

FIG. 6 shows a method of controlling a projectile.

Figure 1:
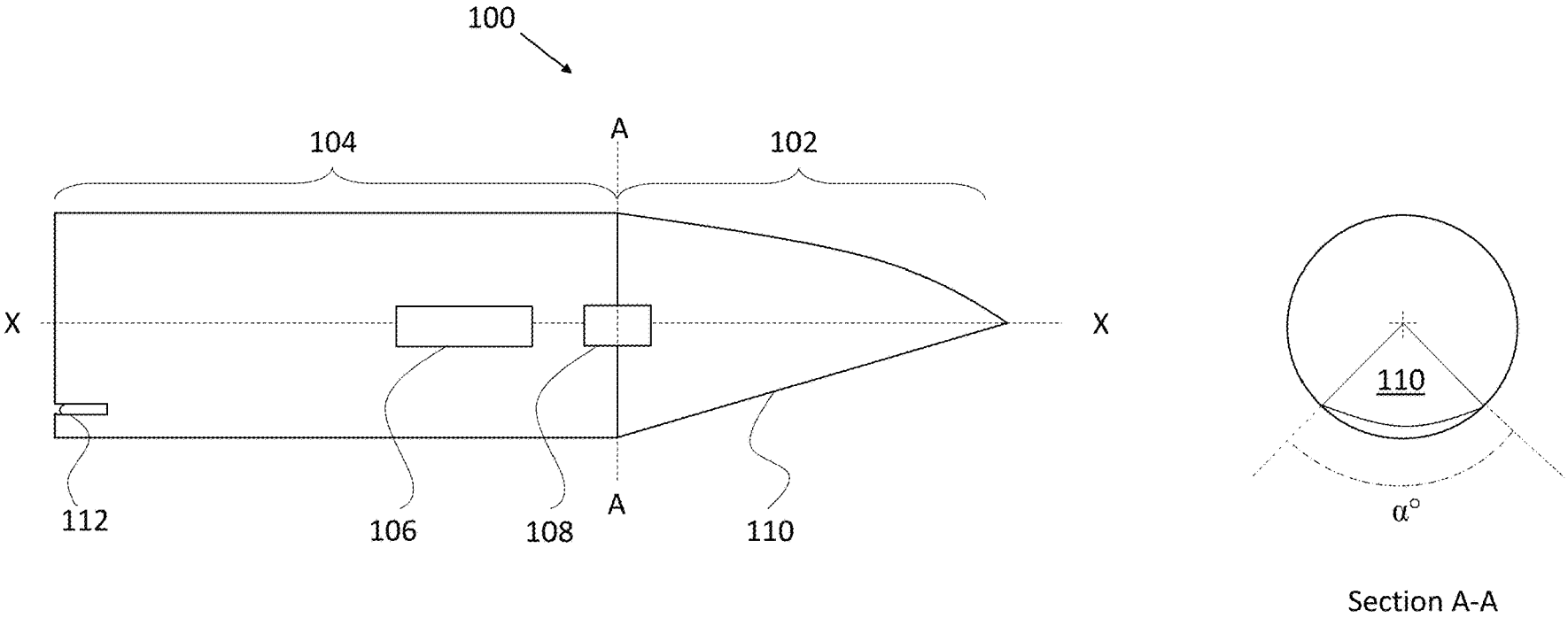
FIG. 1 shows a generic arrangement of the projectile.

Turning to FIG. 1, there is provide a projectile 100 comprising: a front ogive section 102, an aft section 104; and a control module 106; wherein the front ogive section 102 is rotatably connected to the aft section 104 by a coupling device 108, the front ogive section 102 further comprising an asymmetric surface 110, where in use, the angular rotation of the front ogive section 102 can be selectively adjusted relative to the aft section 104 by commands from a control module 106 to the coupling device 108, such that the asymmetric surface 110 exerts an imbalance upon the projectile to selectively alter the trajectory of said projectile, and thereby steer and course correct the projectile.

In the present arrangement, the projectile is a gun launched projectile, such as a medium calibre shell wherein the front ogive section 102 and aft section 104 are made from steel. For simplicity, features such as fuzes, driving bands, and other typical features are not shown.

In the present arrangement, the coupling device 108 is an active coupling device in the form of a servo motor. The servo motor allows both clockwise and anticlockwise rotation of the front ogive section 102 with respect to the aft section 104.

In the present arrangement, the projectile rotates about axis X.

In the present arrangement, the projectile comprises an electrical slip ring (not shown) between the front ogive section 102 and the aft section 104.

In the present arrangement, the asymmetric surface 110 is an aerodynamic lifting surface, specifically a truncated ogive. Said asymmetric surface extends $\alpha°$, in this example 90°, around the plane face of the projectile as seen in Section A-A.

In the present arrangement, the projectile 100 comprises a continuous surface such that the outer profile of the projectile 100 is smooth blended surface absent from protruding fins or protruding control surfaces.

In the present arrangement, the projectile may comprise a receiver for receiving guidance instructions from an external targeting system in the form of an optical receiver 112. Said optical receiver 112 is in communication with the control module 106 and is a beam rider receiver such that the optical receiver senses the intensity of a guidance laser (not shown) wherein the control module 106 is configured to detect drift of the laser focus from the optical receiver 112 wherein the control module 106 issues commands to the coupling 108 in order to remain on the laser path.

Figure 2:
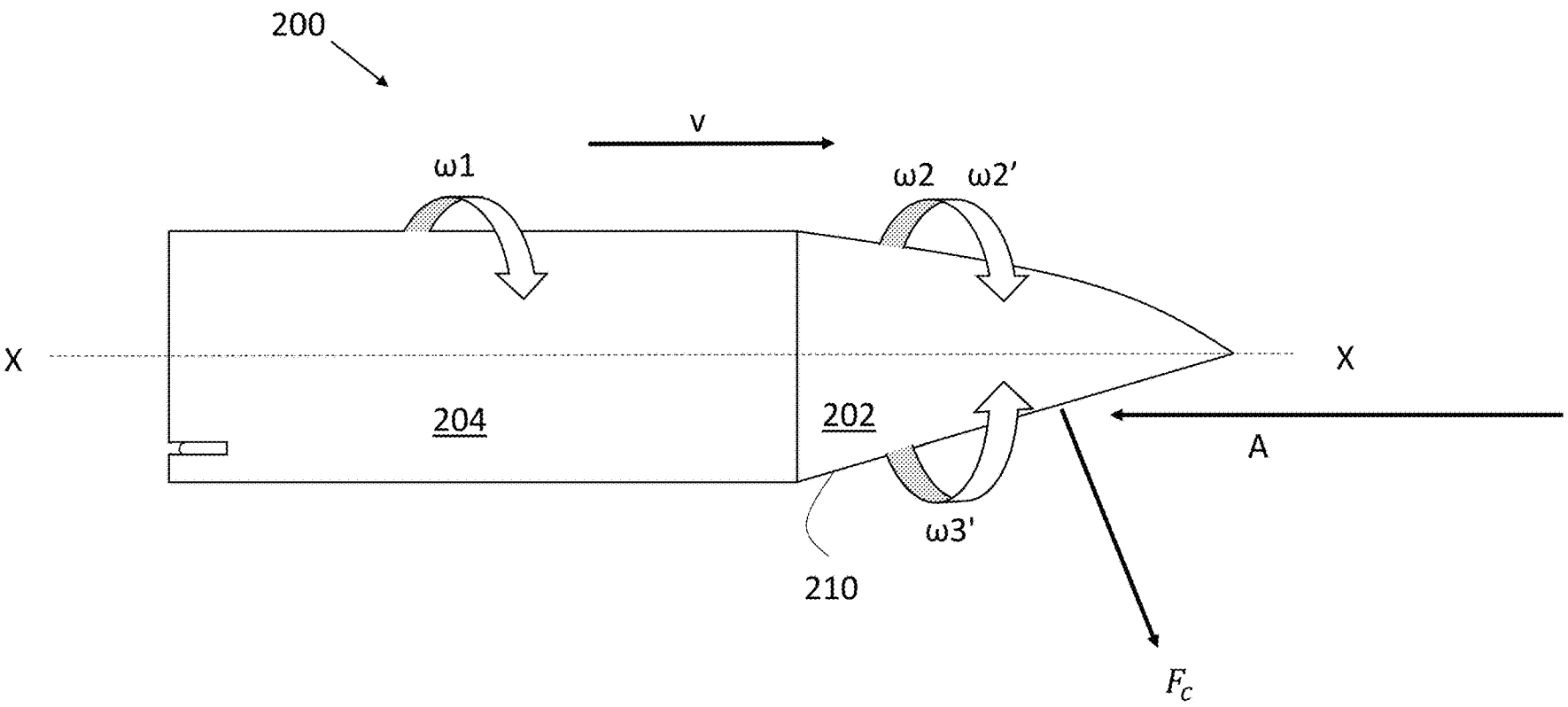
FIG. 2 shows a force diagram of the projectile of FIG. 1.

Turning to FIG. 2, there is provided the projectile of FIG. 1 as a force diagram. The projectile 200 comprising both front ogive section 202 and aft section 204 travelling at velocity v. In this arrangement the projectile is fired from a rifled barrel, the aft section 204 and ogive 202 both rotate at the same clockwise angular rotation ω1 & ω2 respectively against oncoming airflow A. The oncoming airflow A is deflected by the asymmetric surface 210 to create a first imbalanced force vector $F_c$ on the projectile.

On command of the control module (not shown), the servo motor changes the rate of angular rotation of the ogive 202, to either a reduced clockwise ω2' angular rotation rate or an anticlockwise ω3' with respect to the aft section 204 which continues to rotate at angular speed ω1 thereby creating a second imbalanced force vector $F_c$ on the projectile, i.e. altering the angle of the force vector $F_c$ about the axis X.

Alternatively, the coupling device may be a passive coupling device in the form of a brake. The brake can be selectively braked and un-braked to uncouple the front ogive section from the aft section thus allowing the front ogive section to slow due to an aerodynamic roll damping moment.

Turning to FIGS. 3*a* & 3*b*, there is provided a projectile 300 as shown in FIG. 1, travelling in a helical path substantially along the axis x after firing from a rifled barrel.

In FIG. 3*a*, the front ogive section and aft section are in the coupled mode, i.e. both sections spin at the same angular rotation, the helix radius is r1 on the superimposed YZ plane.

In FIG. 3*b*, the front ogive section and aft section are in the decoupled mode, i.e. the front ogive section is spinning at a different angular rotation compared to the aft section, the helix radius is r2 on the superimposed YZ plane, wherein radius r2 is greater than radius r1. The control force from the aerodynamic surfaces on the ogive act in a tangential direction for longer, resulting in a larger radial acceleration. The projectile thus travels further radially before the control force rotates to oppose the motion. The result is that in the decoupled state, the trajectory forms a larger helix r2 diameter than in the coupled mode r1. When the control module calculates that the projectile is on trajectory to hit the intended target, the front ogive section and aft section re-couple such that the front ogive section is restored to the spin rate of the faster spinning aft section thus returning to a helix radius r1 as shown in FIG. 3*a*.

Turning to FIG. 4, there is provided a system 400 for controlling a projectile, the system comprising a projectile 402 as shown in FIG. 1 fired from a rifled artillery gun 404 towards a target 406 along a nominal trajectory 408. After firing, the coupling device of projectile 402 is coupled such that the front section spins at the same angular rotation as the aft section, the projectile travelling in a first helical trajectory with radius r1. Later in flight, the projectile 402' coupling device is decoupled, the front section spins at a different angular rotation relative to the aft section, the projectile travelling in a second helical trajectory with radius r2, wherein the first helical radius r1 is smaller than the second helical radius r2, thereby enabling the projectile 402 to be steered to the target 406.

In the present arrangement, there is provided an external targeting system in the form of a laser designator 410. Said laser designator is trained on the target 406 by beam 412. The laser designator in optical communication with the projectile 402 comprising an optical receiver on the projectile via optical signals 414.

Turning to FIG. 5, there is provided a system for controlling a projectile 500, the system comprising a projectile 502. In the present arrangement, said projectile 502 is a small arms calibre bullet fired from a rifle 504 towards a target 506 along a nominal trajectory 508. After firing, the coupling device of projectile 502 is coupled such that the front section spins at the same angular rotation as the aft section, the projectile travelling in a first helical trajectory with radius r1.

Later in flight, the projectile 502' coupling device is decoupled, the front section spins at a different angular rotation relative to the aft section, the projectile travelling in a second helical trajectory with radius r2, wherein the first helical radius r1 is smaller than the second helical radius r2. The second helical radius corrects the projectile flightpath such that the projectile is on a trajectory which will hit the target 506 wherein the front ogive section couples with the aft section to travel in a third helical trajectory with radius r3, wherein the third helical radius is smaller than radius r2, thereby enabling the projectile 502 to be steered to the target 506. The projectile is further able to couple and decouple multiple times during flight to switch between larger and smaller helical trajectories in order to correct the trajectory to target 506.

In the present arrangement, there is provided an internal guidance system within the control module (not shown) of the projectile 502 in the form of an accelerometer and gyroscope wherein the projectile can inherently calculate its position and issue instructions to the coupling device to guide the projectile 502 to the target 506 without reference to an external targeting system.

Turning to FIG. 6, there is provided a method flow diagram 600 for controlling a projectile as herein described, the method comprising:

610: firing the projectile from a barrel;

620: determining the target location,

630: calculating guidance commands to change the trajectory of the projectile to intercept the target,

640: causing said guidance command to instruct the control module to steer the projectile to a target;

wherein in a first arrangement the coupling device is coupled, such that the front section spins at the same angular rotation as the aft section, the projectile travelling in a first helical trajectory, in a second arrangement the coupling device is decoupled, such that the front section spins at a different angular rotation relative to the aft section, the projectile travelling in a second helical trajectory, said first helical trajectory comprising a smaller radius than the second helical trajectory, comprising the step of selective activation between the first and second arrangements, to cause a change in direction,

650: thereby enabling the projectile to be steered to the target.

The invention claimed is:

1. A projectile comprising:

an aft section;

a front ogive section rotatably connected to the aft section by a coupling device, the front ogive section comprising an ogive surface such that the ogive surface exerts an imbalance upon the projectile;

a control module; and a continuous surface such that an outer profile of the projectile including the ogive surface is a smooth blended surface absent from protruding fins or protruding control surfaces;

wherein the control module is configured to provide commands to the coupling device to selectively adjust an angular rotation of the front ogive section relative to the aft section in both a clockwise angular rotational direction and an anticlockwise angular rotational direction, in a first arrangement, the coupling device is coupled, such that the front ogive section spins at a same angular rotation as the aft section, the projectile travelling in a first helical trajectory, in a second arrangement, the coupling device is decoupled, such that the front ogive section spins at a different angular rotation relative to the aft section, the projectile travelling in a second helical trajectory, said first helical trajectory comprises a smaller radius than the second helical trajectory, and selective activation between the first and second arrangements, causes a change in direction thereby steering the projectile towards a target, and wherein the front ogive section is configured to deform from a symmetric surface into an asymmetric surface after firing.

2. The projectile according to claim 1, wherein the asymmetric surface is an aerodynamic lifting surface.

3. The projectile according to claim 2, wherein the aerodynamic lifting surface is a truncated ogive.

4. The projectile according to claim 1, comprising a retractable element to selectively create the asymmetric surface.

5. The projectile according to claim 1, wherein the coupling device is a passive coupling device.

6. The projectile according to claim 5, wherein the passive coupling device is a brake or clutch.

7. The projectile according to claim 1, wherein the projectile has an outer profile that is continuous.

8. The projectile according to claim 1, wherein the projectile is a spun projectile to be fired from a rifled barrel.

9. The projectile according to claim 1, wherein the projectile comprises a receiver for receiving guidance instructions.

10. The projectile according to claim 9, wherein the receiver is a beam rider receiver.

11. The projectile according to claim 1, wherein the projectile comprises a transmitter to transmit the position of the projectile.

12. A system for controlling a projectile, the system comprising:

the projectile according to claim 1, and;

a targeting system, wherein the control module of the projectile receives guidance instructions from the targeting system thereby enabling the projectile to be steered to the target.

13. The system of claim 12, wherein the control module is governed by the quasi-dynamic guidance law equation:

$$V_{PT}(d) = \begin{bmatrix} V_{lim}(d) - \xi \\ V_k \\ 0 \end{bmatrix} \forall\, d \in \begin{cases} d_1 \le d \\ d_2 \le d < d_1 \\ 0 \le d < d_2 \end{cases},$$

wherein $V_{PT}(d)$ is a lateral speed at which the projectile closes the target, $V_{lim}(d)$ is a maximum lateral speed correction the projectile is capable of making at full, saturated actuator effort, $\xi$ is a delay modification value, $V_k$ is a constant speed, d is a lateral distance to target, $d_1$ is a distance to switch from $V_{lim}(d)-\xi$ to $V_k$, $d_2$ is a level of accuracy of the projectile.

14. A method of controlling the projectile of claim 1, the method comprising:

firing the projectile from a barrel;

determining a location of the target;

calculating guidance commands to change the trajectory of the projectile to intercept the target; and causing said guidance commands to instruct the control module to steer the projectile to the target.

15. The method of claim 14, wherein causing said guidance commands to instruct the control module to steer the projectile to the target results in the control module causing the coupling device to selectively couple and decouple the front ogive section and the aft section based on the guidance commands.

16. The projectile according to claim 1, wherein the coupling device is an active coupling device.

17. The projectile according to claim 1, wherein in the second arrangement, the coupling device is decoupled, such that the front ogive section spins at a slower angular rotation relative to the aft section.

18. A projectile comprising:

an aft section;

a front ogive section rotatably connected to the aft section by a coupling device, the front ogive section comprising an ogive surface such that the ogive surface exerts an imbalance upon the projectile;

a control module configured to cause the coupling device to selectively couple and decouple the front ogive section and the aft section, based on commands from the control module to the coupling device, thereby steering the projectile towards a target; and a continuous surface such that an outer profile of the projectile including the ogive surface is a smooth blended surface absent from protruding fins or protruding control surfaces;

wherein the control module is configured to provide commands to the coupling device to selectively adjust an angular rotation of the front ogive section relative to the aft section in both a clockwise angular rotational direction and an anticlockwise angular rotational direction, in a first arrangement, the coupling device is coupled, such that the front ogive section spins at a same angular rotation as the aft section, the projectile travelling in a first helical trajectory, and in a second arrangement, the coupling device is decoupled, such that the front ogive section spins at a different angular rotation relative to the aft section, the projectile travelling in a second helical trajectory, and wherein the front ogive section is configured to deform from a symmetric surface into an asymmetric surface after firing.

19. The projectile according to claim 18, wherein the first helical trajectory comprises a smaller radius than the second helical trajectory.

* * * * *